United States Patent [19]

Creskoff

[11] 4,166,648

[45] Sep. 4, 1979

[54] VACUUM LIFTING APPARATUS

[76] Inventor: Jacob J. Creskoff, 200 N. Wynnewood Ave., Wynnewood, Pa. 19096

[21] Appl. No.: 836,788

[22] Filed: Sep. 26, 1977

[51] Int. Cl.[2] ..... B66C 1/02

[52] U.S. Cl. ..... 294/64 R

[58] Field of Search ..... 294/64 R, 64 A, 64 B, 294/65; 214/650 SG, 8.5 D; 248/206, 362, 363

[56] References Cited

U.S. PATENT DOCUMENTS

| | | | |
|---|---|---|---|
| 2,815,240 | 12/1957 | Lytle | 294/64 R |
| 3,117,815 | 1/1964 | Creskoss | 294/64 R |
| 3,154,306 | 10/1964 | Elliott et al. | 294/64 R |
| 3,677,598 | 7/1972 | Becker | 294/64 R |

*Primary Examiner*—James B. Marbert

[57] ABSTRACT

A vacuum lifting apparatus is disclosed for lifting large, heavy objects, wherein the lifting surface of the object deviates somewhat from a planar configuration as in the case of manufacturing deficiencies or where the object is of a flexible nature. A frame has opposed surfaces with a generally peripheral deformable closed-cell resilient gasket partially secured to one surface of the frame along the inner peripheral portions of the gasket in an endless arrangement which defines an open chamber with the frame. A source of reduced atmospheric pressure such as a vacuum pump, selectively communicates with the chamber through a valve, such that positioning the gasket member against the object and drawing a vacuum in the chamber thus creates an atmospheric grip between the frame and the object whereby the object may be lifted by lifting the frame. If the lifting surface is inaccurate, or when the object flexes and assumes a curbed configuration, the partial attachment of the gasket thus permits the gasket to decompress and to flex in accordance with the curvature of the object, thereby maintaining the vacuum within the chamber.

13 Claims, 6 Drawing Figures

VACUUM LIFTING APPARATUS

BACKGROUND OF THE INVENTION

1. Field of the Invention

This invention relates to a vacuum lifting apparatus particularly suitable for lifting large heavy objects having lifting surface deviations caused by the flexibility of the object, manufacturing defects and the like.

2. Description of the Prior Art

Devices for lifting large objects through the development of a suitable vacuum have been generally known because of the substantial nature of the gripping forces which may be developed through the evacuation of a space between the lifting mechanism and the object to be lifted. Vacuum lifting devices have been used quite extensively for lifting large, heavy objects since the problems of lifting large concrete slabs or heavy steel plates are quite readily overcome through the application of a vacuum lifting device.

My U.S. Pat. No. 3,117,815 dated Jan. 14, 1964 relates to a Vacuum Lifter having a rigid structure capable of supporting extremely heavy objects. The lifter utilizes the concept of evacuating the air from an enclosed space between a lifting frame and an object to be lifted, wherein the enclosed space is subdivided by deformable gaskets into inner and outer chambers. The chambers communicate through passages such that total evacuation of the space therebetween is accomplished in several stages. This arrangement makes it possible to engage and disengage the object in a rapid fashion. My commonly assigned U.S. Pat. No. 3,833,251 dated Sept. 3, 1974 relates to a vacuum lifter specifically adapted for lifting arcuately shaped objects by an arrangement of structural members adapted to accommodate arcuately configured objects dimensioned within a suitable range of diameters.

While such devices have proven to be extremely successful in lifting extremely heavy, rigid objects having flat lifting surfaces, as well as relatively lighter curved or arcuate objects, it has been extremely difficult to devise a vacuum lifting apparatus capable of lifting either relatively flexible objects of substantial weight, or large heavy objects having deviations in the planar lifting surface, primarily because the atmospheric grip developed between the frame and the object has been found to be vulnerable to atmospheric leaks, which render the apparatus incapable of supporting the object. For the case of inherent defects in the lifting surface the substantial weight of the object makes it difficult to maintain the atmospheric grip thus developed. For the case of flexible objects, deviations are developed in the lifting surface during lifting when the object flexes.

For flexible objects, the problem is most readily recognized upon consideration of the difficulties inherent in lifting a large steel plate having an area of, say 150–200 square feet and a thickness of ⅛–174 inch. The flexibility of such a plate is such that upon lifting the plate in the central portion with a vacuum lifting device of the known type, the forces of gravity acting downwardly on the outer portions of the steel plate, combines with the upward force provided by the vacuum lifting apparatus and associated lifting devices and results in the development of a compound curvature in the flexible plate. When the curvature of the plate reaches a predetermined level, it cannot be accommodated merely by non-uniform decompression of the gasket, with the result that an air leak is developed and the vacuum is lost, causing the plate to be released in mid-air.

When the surface of the object to be gripped deviates somewhat from a planar surface, the atmospheric vise thus created by a rigid vacuum lifting device of the type described will also be vulnerable to atmospheric leaks.

Because large objects such as steel plates and the like are often substantial in weight, it is desirable to provide a lifting apparatus having a structure which is sufficiently rigid and capable of supporting such heavy objects while providing sufficient flexibility with respect to the creation of an atmospheric grip so as to accommodate any deviations which may appear in the object lifting surface without affecting adversely the ability to support such heavy objects. I have invented a vacuum lifting device which is not only capable of supporting extremely heavy, rigid, and relatively flexible objects, but which will readily accommodate deviations from a planar character, of the lifting surface, notwithstanding the cause for such deviation.

SUMMARY OF THE INVENTION

The invention relates to a vacuum lifting apparatus for lifting objects which comprises a frame member having at least one generally continuous surface portion and deformable resilient gasket means having a generally peripheral configuration partially secured along inner peripheral portions thereof to a surface portion of the frame member so as to define an open chamber, means for communicating the chamber with a source of relatively reduced pressure to provide an atmospheric attachment between the frame member and the object.

The gasket means is preferably formed of a compressible, suitable cellular elastomeric material such as closed-cell neoprene gasket material in which the cells are unconnected and an atmospheric barrier is provided between the frame member and the gasket. The gasket means may either be comprised of a single piece gasket member having an endless peripheral configuration, or it may be formed of a plurality of gasket sections forming an endless peripheral configuration. In the description which follows, the expression "gasket member" shall be used to refer to any of these gasket configurations.

Since the total area of the lifting apparatus is always substantially less than the total area of the object being lifted, the anticipated curvature in the object may be accommodated by selective application of gasket members of appropriate thickness, suitably selected to take into consideration the various interrelated parameters. In most applications, I have found that for a peripheral gasket member having a 1 inch square cross section, the development of a vacuum in the space between the frame member and a large flexible object will result in an initial compression of the gasket to, say, ⅜ inch. Subsequently, upon lifting the object the upward force acting on the central portion of the object combines with the weight of the end portions of the object and results in the development in the object, of a compound curve, with a nonuniform decompression of the gasket means.

For such applications, I have found that adhesively securing the inner peripheral portions of the upper surface of the gasket member to the under surface of the frame member, combines the flexible and resilient features of the gasket member and permits nonuniform decompression and flexing of the gasket to accomodate any curvature which may develop in the gripping surface of the object when it is lifted. While it is anticipated that the outer peripheral portions of the gasket member may become fully decompressed and, if necessary, will flex downwardly to further accommodate deviations in the lifting surface of the object, the inner peripheral portions of the gasket member will also become decompressed; however, the decompression of the inner peripheral portions of the gasket member will be somewhat less than the decompression in the outer peripheral portions.

In general, the percentage of the inner peripheral portions of the gasket member which are adhesively secured to the frame member may depend upon the particular lifting requirements. However, I have found that in most cases, best results are obtained by adhesively securing the inner peripheral surface portions of the gasket member to the under surface of the frame member over the surface extending from the inner periphery to a point approximately midway between the inner periphery and the outer periphery.

It is foreseen within the scope of the present invention to incorporate the features of my rigid vacuum lifter as described in my U.S. Pat. No. 3,117,815 so as to utilize along with the present development, the advantages of rapid engagement and disengagement associated with that earlier development.

BRIEF DESCRIPTION OF THE DRAWINGS

Preferred embodiments of the invention are described hereinbelow with reference to the accompanying drawing wherein.

DETAILED DESCRIPTION OF THE PREFERRED EMBODIMENT

Figure 1:
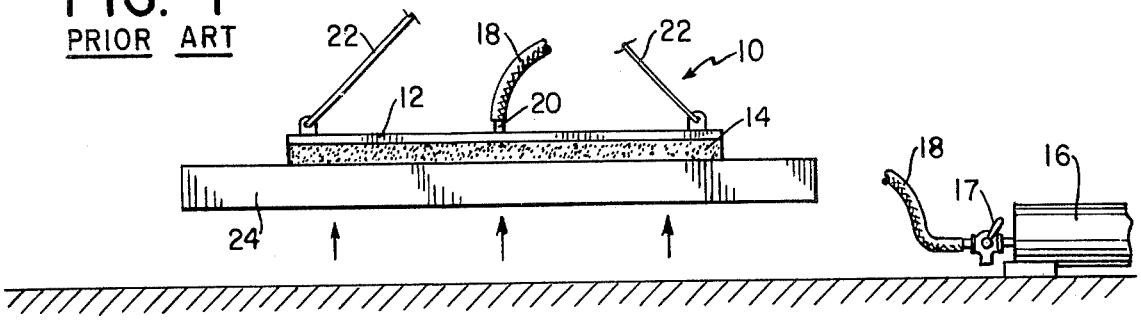
FIG. 1 PRIOR ART
FIG. 1 is a side elevation of a vacuum lifting apparatus constructed according to the prior art and illustrating the operation thereof.
Figure 2:
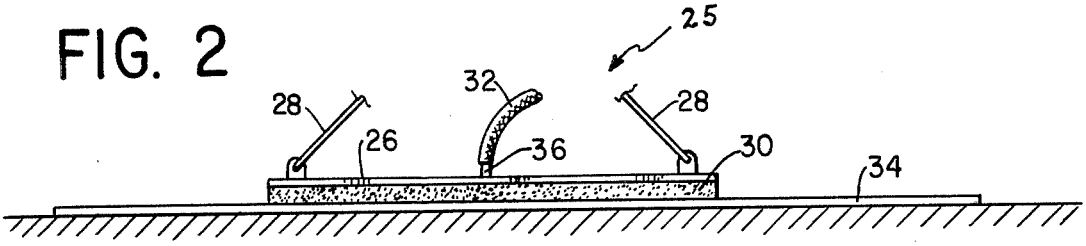
FIG. 2 is a side elevation of a vacuum lifting apparatus constructed according to the present invention in position for lifting a large relatively thin steel plate.

Referring initially to FIG. 1, there is illustrated a vacuum device 10 constructed in accordance with the principles of the prior art, wherein a frame member 12 has secured thereto an endless peripheral gasket 14 of closed-cell elastomeric material. The gasket 14 has its upper peripheral surface portion secured directly to the lower surface of the frame member 12 by a suitable adhesive material. A vacuum pump 16 communicates with the inner chamber formed between the frame 12 and the peripheral gasket 14 through flexible hose 18, nipple 20 and a port (not shown in FIG. 1) extending through frame 12. Struts 22 are connected to the frame 12 for lifting an object 24.

In operation, lifting is accomplished by positioning frame member 12 and gasket 14 against the upper surface of object 24. Thereafter, vacuum pump 16 operates through valve 17 to evacuate the air via hose 18 and nipple 20 from the space surrounded by the gasket 14 between the frame member 12 and the object 24 to provide a vacuum sufficient to create an atmospheric vise between the frame member 12 and the object 24. Up to the present, such lifting techniques have been quite satisfactory when the objects to be lifted were of rigid construction as, for example, concrete slabs, heavy steel plates and the like, where deformation of the object under the compound influence of gravity and the lifting forces did not cause significant deformation of the object.

Thus, with the arrangement of FIG. 1, lifting large, heavy objects which are either flexible, or which have a lifting surface which deviates from a true planar configuration, the results obtained were not always successful. For example, flexible objects developed a compound curved shape and the curve exceeded the limits of compression and decompression of the peripheral gasket. Objects having a defective lifting surface provided the same effect. Such circumstances inevitably resulted in the sudden loss of the grip on the object. It is apparent that the actual point at which the vacuum will be lost depends upon the relative sizes between the frame member and the object and, in addition, upon the thickness of the gasket relative to the curved configuration assumed by the object during the lifting process.

Figure 5:
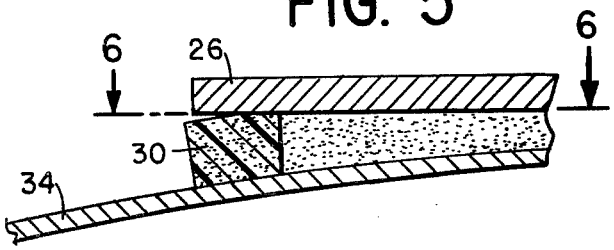
FIG. 5 is a cross-sectional view similar to FIG. 4, illustrating the flexible deformation of the gasket member during the lifting operation of a large, relatively flexible object.
Figure 6:
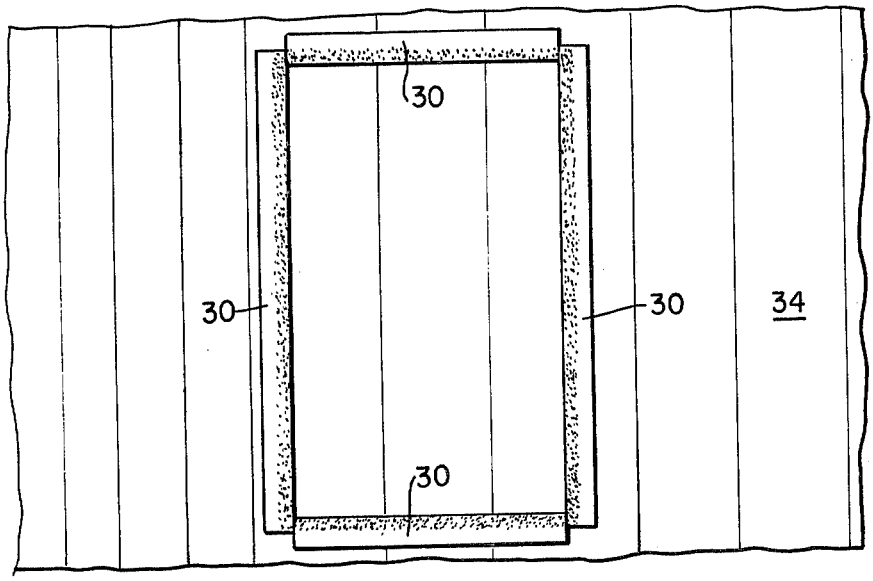
FIG. 6 is a view taken along lines 6—6 of FIG. 5.

Referring now to FIGS. 2 through 6, there is illustrated a vacuum lifting apparatus 25 constructed according to the present invention. A frame 26, in the form of a plate, has suitable struts connected thereto for lifting, and a generally peripheral gasket member 30 secured by an adhesive material to the under surface of the frame 26. As seen in FIG. 6, the gasket member 28 forms a generally endless configuration and may be comprised of a single continuous gasket member or of several sections of gasket material arranged in an endless array. The portion of gasket member 30 which is adhesively secured to frame 26 preferably extends over the inner peripheral surface as shown. This portion actually extends from the inner periphery of the gasket midway to the outer periphery as shown clearly in FIGS. 4 and 5. A vacuum pump and valve arrangement similar to the arrangement of FIG. 1 selectively communicates through hose 32, nipple 36 and an opening in frame 27, with the chamber formed between the gasket 30 and the frame 26. The gasket 30 is of a closed-cell elastomeric material such as closed-cell neoprene. The cross sectional and overall dimensions of the gasket 30 relative to the dimensions of the frame 26 will depend upon the particular lifting requirements.

Figure 3:
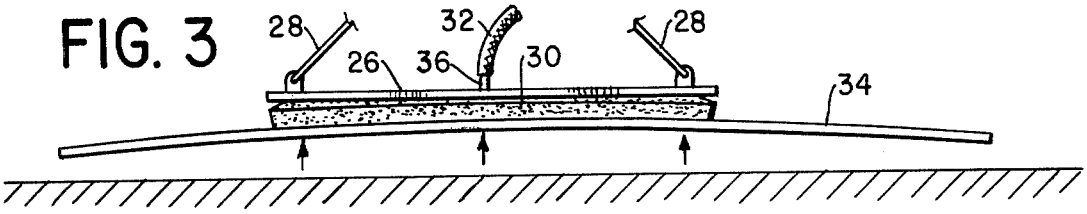
FIG. 3 is a side elevation of the apparatus of FIG. 2 in the process of lifting the steel plate.
Figure 4:
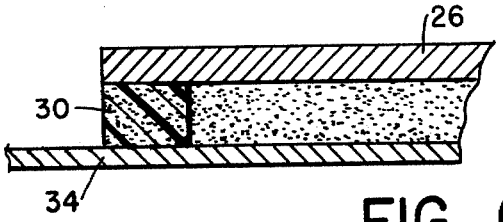
FIG. 4 is a cross-sectional view of a portion of the apparatus of FIG. 3 illustrating a portion of the frame member thereof, a gasket member partially secured thereto, and the plate to be lifted.

The relative dimensional relations between an exemplary apparatus and an exemplary plate to be lifted may be helpful to fully appreciate the advantages provided by the present invention. Frame 26, approximately 1 ft. in width and 4 ft. in length is to be utilized to lift a steel plate 34 having a thickness of ¼ inch, a width of 7 ft. and a length of 20 ft. The plate member weighs approximately 1,400 lbs. Positioning the apparatus in engagement with the plate member, with the 1 ft. dimension of the frame parallel to the 20 ft. length of the plate and thereafter drawing a vacuum through hose 32 in the space between the frame 26 and the plate 34, the atmospheric vise thus created is sufficient to lift and support the plate 34 with frame 26 by lifting struts 28. When the plate is lifted above floor level as shown in FIG. 3, it will assume the curvature illustrated in FIGS. 3 and 5, particularly due to the relative dimensions between the vacuum lifting apparatus and the plate 34. It can be seen that the upward lifting force at the center of the plate reacts against the downward gravitational force with the result that the plate assumes the configuration of a compound curve.

As can be seen in FIGS. 3 and 5, when the steel plate 34 is lifted, it will assume a compound curvature under the influence of the upward lifting force and the force of gravity. The precise curve will depend upon the flexibility of the plate. The fact that the outer peripheral portion of the gasket 30 is not adhesively secured to the under surface of the frame 26, will permit this portion of the gasket to flex downwardly after decompression has taken place. Such decompression and downward flexing will permit the plate to retain the curvature assumed under the influence of gravity, with no loss of the atmospheric grip. It will serve to retain the seal between the frame 26, the plate 34 and the gasket 30. This arrangement permits continued retention of the lifting force on flexible objects, particularly due to the fact that decompression of the gasket 30, and the flexibility of the outer peripheral portion thereof, is permitted by the absence of an adhesive relationship between the outer peripheral portions of the gasket 30 and the under surface of the frame 26. As can be seen in FIG. 5, when plate 34 is lifted and permitted to assume a compound curvature, the portions of the gasket which are not adhesively secured to the frame 26 will become at least partially decompressed and the inner peripheral portions will also become at least partially decompressed. If the curvature assumed by the plate 34 is sufficient to require more than complete decompression of the outer peripheral portions of the gasket, the flexible nature of the gasket will permit the outer peripheral portions to flex downwardly while maintaining the inner peripheral portions in a partially decompressed condition. Thus, the atmospheric grip on the plate will be retained as the plate is supported by the apparatus.

I claim:

1. A vacuum lifting apparatus for lifting an object having a generally continuous surface portion which comprises a frame member having at least one generally continuous surface portion, compressible cellular resilient gasket means having a generally peripheral configuration partially secured along inner peripheral portions thereof to at least a part of said surface portion of said frame member to define an open chamber, means for communicating said chamber with a source of relatively reduced pressure such that when said gasket means is positioned against at least a part of the generally continuous surface portion of the object, and the atmospheric pressure therebetween is reduced to provide an atmospheric attachment between said frame member and the object, the resilient compressibility of said cellular gasket means and the unsecured portions of said gasket means combine to provide substantial atmospheric sealing between said frame member and the object.

2. The vacuum lifting apparatus according to claim 1, wherein each gasket member is comprised of a cellular elastomeric material.

3. The vacuum lifting apparatus according to claim 2, wherein said cellular elastomeric material comprises a closed-cell neoprene.

4. The vacuum lifting apparatus according to claim 3, wherein each gasket member is secured to said frame member over at least approximately 50% of the area of each gasket member facing said frame member.

5. The vacuum lifting apparatus according to claim 4, wherein each gasket member is secured to said frame member over a surface portion extending from the inner periphery to at least approximately midway to the outer periphery thereof.

6. The vacuum lifting apparatus according to claim 5, wherein said gasket means comprises a plurality of gasket members arranged to form a generally endless peripheral configuration.

7. The vacuum lifting apparatus according to claim 6, further comprising means to control the communication between said chamber and said source of relatively reduced pressure, to thereby control the atmospheric attachment created between said frame member and the object.

8. The vacuum lifting apparatus according to claim 7, wherein said control means comprises valve means positioned in communicating relation between said chamber and said source of relatively reduced pressure.

9. The vacuum lifting apparatus according to claim 8, wherein said frame member comprises a plate member having opposed surface portions, at least the lower surface portion being generally continuous and substantially flat.

10. The vacuum lifting apparatus according to claim 9, wherein each gasket member is partially secured to the lower surface portion of said plate member by an adhesive material.

11. A vacuum lifting apparatus for lifting an object having at least one generally continuous surface portion which comprises a frame member having at least one generally continuous surface portion corresponding substantially to the generally continuous surface portion of the object, compressible cellular resilient gasket means having a generally peripheral endless configuration partially secured along inner peripheral portions thereof to at least a part of said generally continuous surface portion of said frame member to define an open chamber, means for communicating said chamber with a source of relatively reduced atmospheric pressure such that when said gasket means is positioned against at least a part of the generally continuous surface portion of the object, and the atmospheric pressure therebetween is reduced to provide an atmospheric attachment between said frame member and the object, the resilient compressibility of said cellular gasket means and the unsecured portions of said gasket means combine to provide substantial atmospheric sealing between said frame member and the object, notwithstanding deviations between the generally continuous surface portion of the object and said generally continuous surface portion of said frame member.

12. A vacuum lifting apparatus for lifting an object having at least one generally continuous surface portion which comprises a frame member having at least one generally continuous surface portion corresponding substantially to the generally continuous surface portion of the object, at least one compressible, closed cell resilient gasket means forming a generally peripheral, generally endless configuration partially secured along inner peripheral portions thereof to at least part of said generally continuous surface portion of said frame member to define an open chamber with said frame member, means for selectively communicating said chamber with a source of reduced pressure relative to the atmosphere, such that positioning said gasket means in engagement with at least a part of the generally continuous surface portion of the object and reducing the atmospheric pressure within said chamber to provide an atmospheric attachment between said frame member and the object for lifting, the unsecured peripheral portions of said gasket means permits said gasket means to become at least partially decompressed and to flex sufficient to accommodate corresponding deviations between said generally continuous surface portion of said frame member and the generally continuous surface portion of the object, thereby maintaining the atmospheric attachment between said frame member and the object.

13. A vacuum lifting apparatus for lifting relatively large, relatively rigid and relatively flexible objects having at least one generally flat surface portion for lifting, which comprises a plate member having at least one generally flat lifting surface portion corresponding substantially to the lifting surface portion of the object, compressible, flexible closed cell resilient gasket means forming a generally endless peripheral configuration and being partially secured along inner peripheral portions thereof to at least a part of said generally continuous surface portion of said plate member to thereby define an open chamber with said plate member, a generally tubular member communicating with said chamber formed between said gasket means and said plate member at a location generally central of said chamber, means to selectively communicate said generally tubular member with a source of relatively reduced atmospheric pressure to draw a relative vacuum within said chamber, such that positioning said gasket means in engagement with at least a part of the generally continuous lifting surface portion of the object and operating said atmospheric pressure reducing means to draw a relative vacuum within said chamber creates atmospheric attachment forces between said plate member and the object, such that upon lifting said plate member, the object will be retained thereto by the atmospheric attachment and the partial attachment of said gasket means to said plate member will combine with the resilient flexible compressibility of said closed cell gasket means to permit said gasket means to become at least partially decompressed and to flex sufficient to accommodate deviations between the lifting surface portion of the object and the corresponding lifting surface portion of said frame member to maintain the atmospheric attachment between said frame member and the object.

* * * * *

UNITED STATES PATENT AND TRADEMARK OFFICE

CERTIFICATE OF CORRECTION

PATENT NO. : 4,166,648

DATED : September 4, 1979

INVENTOR(S) : Jacob J. Creskoff

It is certified that error appears in the above-identified patent and that said Letters Patent are hereby corrected as shown below:

In the Abstract

At line 18, "curbed" should read --curved--.

In the Specification

In Column 1, line 58, "1/8 - 174 inch" should read --1/8 - 1/4 inch--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*